United States Patent [19]

Thompson et al.

[11] 4,006,565

[45] Feb. 8, 1977

[54] SQUASH COURT CONSTRUCTION

[76] Inventors: Graham Ralph Thompson; Dean Henry Stone, both of 125 Glenn Osmond Road, Eastwood, South Australia 5063

[22] Filed: Oct. 17, 1975

[21] Appl. No.: 623,470

[52] U.S. Cl. ..... 52/18; 273/29 R

[51] Int. Cl.[2] ..... E04B 7/12; A63B 69/38

[58] Field of Search ..... 52/18, 90, 15, 234, 52/236, 80; 273/29 R

[56] References Cited

UNITED STATES PATENTS

| | | | |
|---|---|---|---|
| 1,883,731 | 10/1932 | Hadden | 273/29 R |
| 3,201,907 | 8/1965 | Henderson | 52/236 |

OTHER PUBLICATIONS

Architectural Record, Jan. 1974, p. 111.

*Primary Examiner*—John E. Murtagh
*Attorney, Agent, or Firm*—Jay L. Chaskin

[57] ABSTRACT

A building containing two rows of squash courts one each side of a central gallery, there being clerestory windows above the gallery, glass walls on each side of the gallery, and divisional walls extending between the gallery glass walls and the side walls so as to form the rows of squash courts each of which receives light through the clerestory windows and glass walls.

8 Claims, 7 Drawing Figures

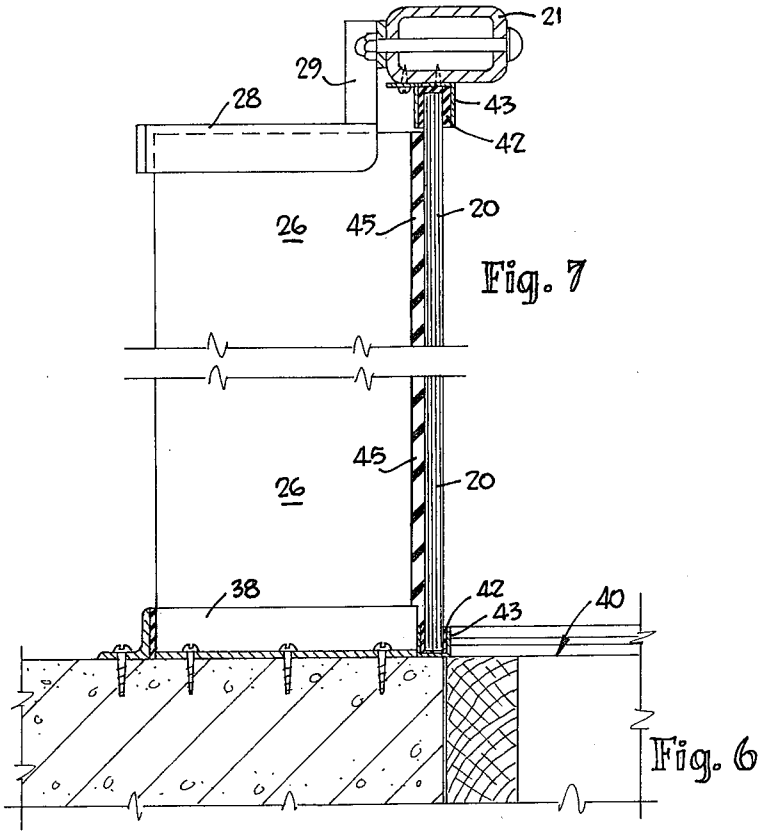
Fig. 7
Fig. 6
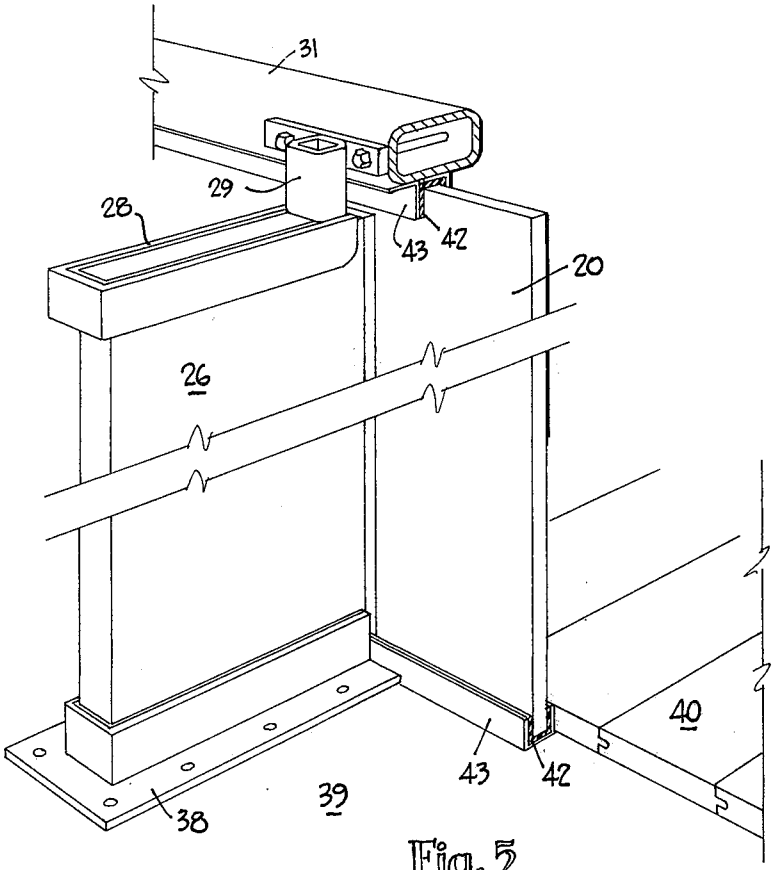
Fig. 5

SQUASH COURT CONSTRUCTION

This invention relates to the construction of a building containing a plurality of squash courts.

BACKGROUND OF THE INVENTION

The usual construction of squash courts has the courts set below a gallery from which visitors may view a game. Such construction is expensive, it is not aesthetically pleasing and frequently the requirements of natural light are not fully met, since the gallery is likely to interfere with the passage of light.

BRIEF SUMMARY OF THE INVENTION

Briefly, in this invention, a structure has two side walls, each side wall terminating in an end wall extending at right angles thereto, roof portions extending towards the centre of the structure from respective side walls, there being provided a gallery disposed centrally between the side walls, clerestory windows above the gallery, and glass division walling defining the side walls of the gallery, there being two rows of squash courts, one row being between each of the side walls and a glass wall of the gallery.

With this arrangement the gallery floor can be on the same level as the floors of the squash courts themselves, and light from the clerestory windows enter each squash court through the glass walls. The glass walls also function as observation walls.

BRIEF DESCRIPTION OF THE DRAWINGS

An embodiment of the invention is described hereunder in some detail with reference to and as illustrated in the accompanying drawings in which FIG. 5 is a fragmentary perspective view drawn to a still further enlarged scale and illustrating a strut arrangement, FIG. 6 is a fragmentary section drawn to a still further enlarged scale and illustrating the detail of the interconnection of the lower divisional wall edge and strut edge with a floor, and FIG. 7 is a view similar to FIG. 6 and illustrating the securing of the respective top edges.

DETAILED DESCRIPTION OF THE EMBODIMENT ILLUSTRATED IN THE DRAWINGS

Figure 1:
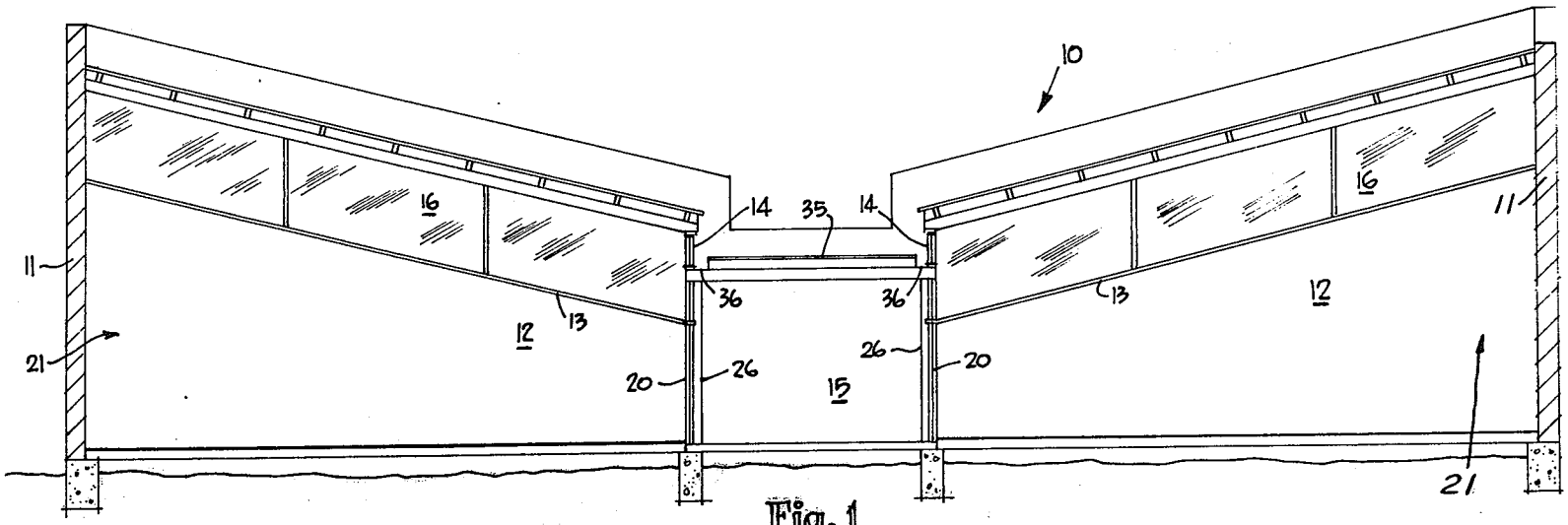
FIG. 1 is a cross-section through a building which houses a plurality of squash courts.
Figure 2:
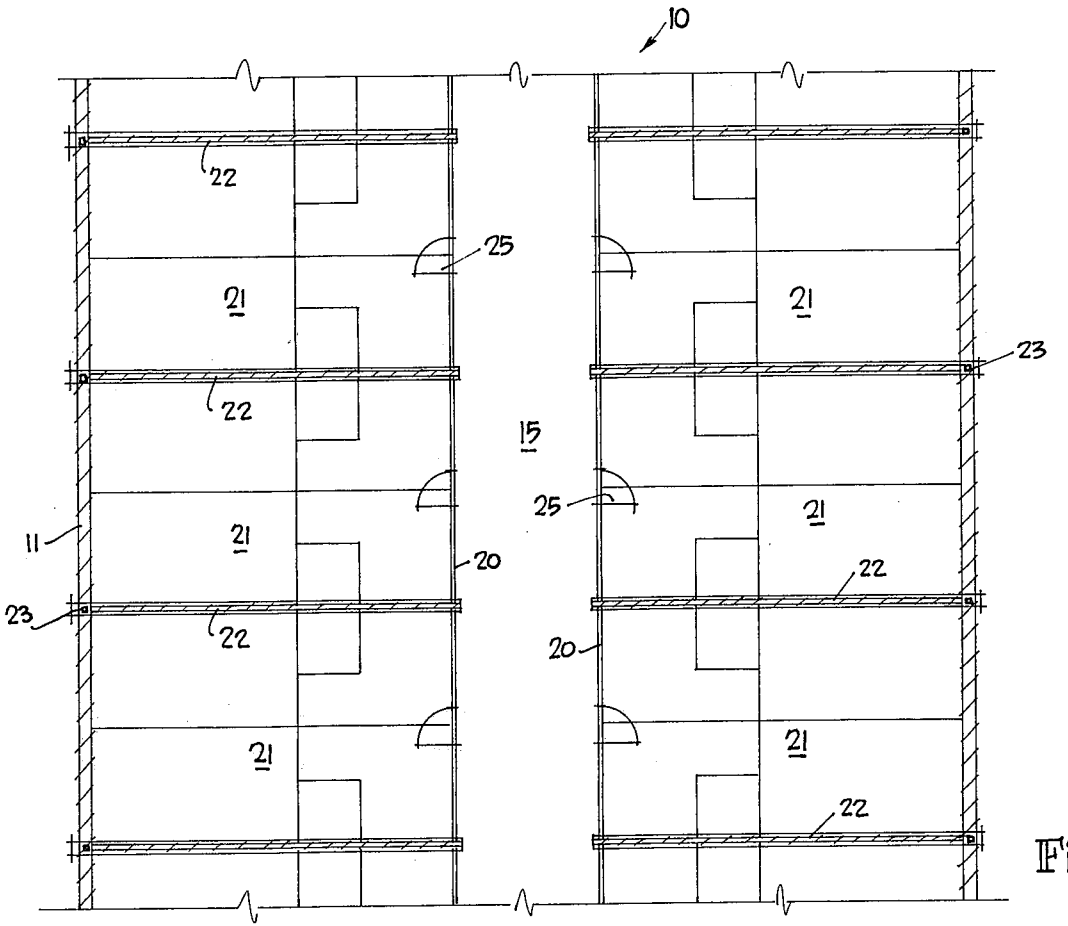
FIG. 2 is a fragmentary plan of the building.

In this embodiment a building 10 is provided with four walls, there being two masonry side walls 11 which are rectangular and two end walls 12. The two end walls 12 are also masonry and have their upper edges 13 sloping downwardly toward the centre of the building, and at the locality of the centre of the building the end walls 12 reduce in height to provide two rows of clerestory windows 14 positioned above the roof of a gallery 15. The upper portions of the end walls are also provided with clerestory windows 16.

Figure 4:
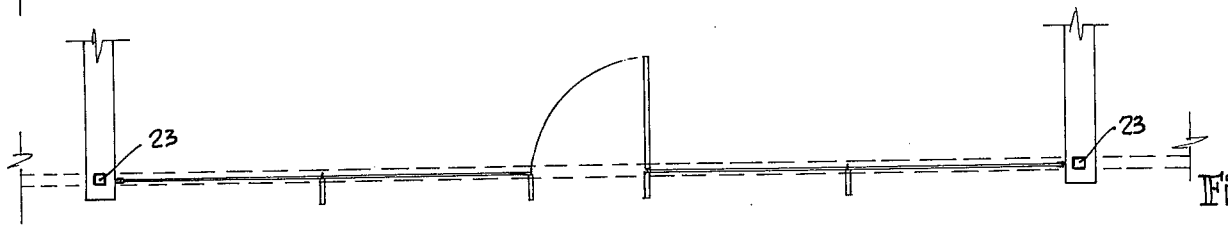
FIG. 4 is a plan of FIG. 3.

The gallery 15 is defined by two glass division walls 20 spaced from one another, and the space between the glass division walls together with the side walls constitutes a plurality of squash courts 21. The courts themselves are divided by masonry walls 22, each division wall 22 extending from a side wall 11 to a tubular column 23 as shown in FIG. 4. Between adjacent courts, in lieu of glass 16 there are provided panels of wire mesh (not illustrated). Respective doors 25 provide access to the courts.

Figure 3:
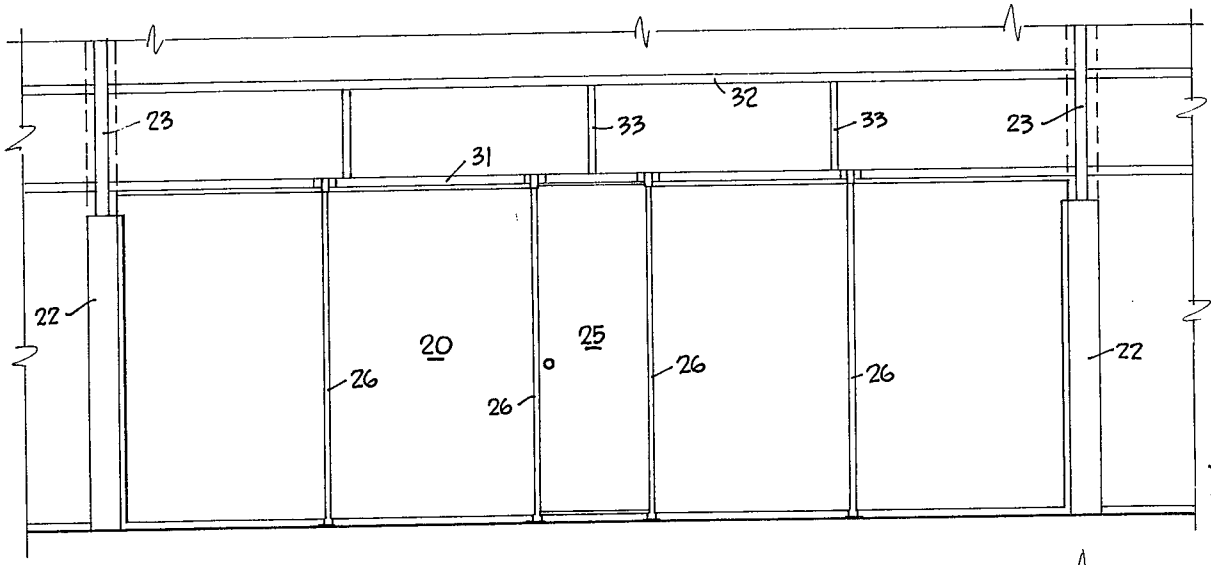
FIG. 3 is an elevational view taken in the direction of arrow 3 of FIG. 1 and illustrating a gallery division wall between a gallery and a court.

Between each pair of adjacent division walls 22, as shown in FIGS. 3 and 4, the glass division wall 20 is itself provided with stiffening struts designated 26. Each strut 26 is secured as shown in FIGS. 5, 6 and 7 at its upper edge in a metal retaining strap 28 which extends over its outer edge surface and its two side surfaces, the strap 28 having a bracket 29 upstanding from its rear end and secured to the lower horizontal frame member 31 which is a rectangular tubular member and extends across the upper edges of the gallery divisional walls 20. The lower horizontal frame member 31 cooperates with a lower horizontal frame member 32 and a series of spaced vertical frame members 33 to constitute the frame for the clerestory windows 14 which are situated above the division walls 20. A flat roof 35, flanked on each side by box gutters 36, covers in the gallery 15 between the clerestory windows 14.

The lower end of each strut 26 is separated on its two sides and end edge by a lower bracket 38 which is formed from interconnected angle members the horizontal flanges of which are secured to a concrete floor 39 of the gallery, the floor 40 of the courts 21 being formed from timber strips placed "on edge" and abutting one another as illustrated best in FIG. 6. It is important that the glass be mounted in such a way that it is unlikely to shatter upon receiving an impact from a ball or racquet, and a resilient mounting is achieved along the upper and lower edges of the division walls 20 by interposing a silicone rubber gasket 42 between those edges and respective channel frame members 43, the upper frame member 42 being secured to the lower surface of the clerestory frame member 31 and the lower being secured to the concrete frame 39 as shown best in FIG. 5. A silicone rubber gasket is also interposed between the upper and lower edges of the struts 26 and the respective supporting members 28 and 38, and a further gasket 45 (FIG. 7) joins the near edge of each strut 26 to the outer face of its division wall 20.

A brief consideration of the above embodiment will indicate that the invention makes possible an effective squash court construction wherein the gallery is at the same height as the court itself, wherein the lighting enters the court from an upper area surrounding the court, and wherein the glass panels are mounted with sufficient resilience to resist cracking under impact or under strain imposed due to the earth movement.

What we claim is:

1. A building containing a plurality of squash courts, comprising two spaced parallel outer side walls, two parallel outer end walls extending between the side walls and each at right angles thereto, two outer roof portions extending between the end walls and terminating at their adjacent edges above spaced parallel clerestory windows, glass walls below the clerestory windows defining between them a central gallery which extends parallel to said side walls, a central roof portion over the gallery, and division walls parallel to the end walls and extending between the side walls and the gallery glass walls defining therebetween said plurality of squash courts, arranged in two rows one on each side of the gallery.

2. A building according to claim 1 wherein the upper edge of each end wall slopes downwardly from a respective said side wall to a said clerestory window.

3. A building according to claim 1 wherein the gallery floor has the same level as the squash court floors.

4. A building according to claim 1 wherein said side walls, end walls and division walls are all masonry walls.

5. A building according to claim 1 further comprising struts extending into the gallery from the glass walls, and jointing means between the struts and the glass walls whereby the struts support the glass walls intermediate their ends.

6. A building according to claim 5 further comprising upper and lower brackets securing respectively the upper and lower ends of each strut, and jointing means between the upper and lower brackets and the strut ends, and wherein each said strut is glass.

7. A building according to claim 5 further comprising upper and lower channel frame members supporting the upper and lower glass wall edges and jointing means therebetween.

8. A building according to claim 5 wherein said jointing means is rubber.

* * * * *